US009177505B2

(12) United States Patent
Lin et al.

(10) Patent No.: US 9,177,505 B2
(45) Date of Patent: Nov. 3, 2015

(54) PIXEL OF A DISPLAY PANEL CAPABLE OF COMPENSATING DIFFERENCES OF ELECTRICAL CHARACTERISTICS AND DRIVING METHOD THEREOF

(71) Applicant: AU Optronics Corp., Hsin-Chu (TW)

(72) Inventors: Chun-Chieh Lin, Hsin-Chu (TW); Ya-Ling Chen, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 181 days.

(21) Appl. No.: 13/928,394

(22) Filed: Jun. 27, 2013

(65) Prior Publication Data

US 2014/0267468 A1 Sep. 18, 2014

(30) Foreign Application Priority Data

Mar. 15, 2013 (TW) ..... 102109309 A

(51) Int. Cl.
*G09G 3/12* (2006.01)
*G09G 3/32* (2006.01)

(52) U.S. Cl.
CPC ..... *G09G 3/3233* (2013.01); *G09G 2300/0819* (2013.01); *G09G 2300/0852* (2013.01); *G09G 2320/0233* (2013.01)

(58) Field of Classification Search
USPC ..... 345/36, 39, 44–46, 74.1–83; 313/484–487, 498–502, 463; 315/169.1–169.4
See application file for complete search history.

(56) References Cited

U.S. PATENT DOCUMENTS

| | | | | |
|---|---|---|---|---|
| 7,045,821 | B2 | 5/2006 | Shih | |
| 7,876,294 | B2 | 1/2011 | Sasaki | |
| 2007/0063932 | A1 | 3/2007 | Nathan | |
| 2009/0174699 | A1 | 7/2009 | Fish | |
| 2011/0025671 | A1 | 2/2011 | Lee | |
| 2012/0154258 | A1 | 6/2012 | Asano | |
| 2013/0300724 | A1* | 11/2013 | Chaji | 345/212 |

FOREIGN PATENT DOCUMENTS

CN 101989403 A 3/2011

* cited by examiner

*Primary Examiner* — Ram Mistry
(74) *Attorney, Agent, or Firm* — Winston Hsu; Scott Margo

(57) ABSTRACT

A pixel of a display panel includes a first transistor with a first end coupled to a data line, a control end coupled to a scan line; a second transistor with a first end coupled to a first voltage source, a control end coupled to a second end of the first transistor; a third transistor with a first end coupled to a second end of the second transistor, a control end for receiving a control signal; a light emitting unit with a first end coupled to the second end of the second transistor, a second end coupled to a second voltage source; a first capacitor with a first end coupled to the second end of the first transistor, a second end coupled to a second end of the third transistor; and a second capacitor coupled between the second end of the first capacitor and the second voltage source.

8 Claims, 13 Drawing Sheets

PIXEL OF A DISPLAY PANEL CAPABLE OF COMPENSATING DIFFERENCES OF ELECTRICAL CHARACTERISTICS AND DRIVING METHOD THEREOF

BACKGROUND OF THE INVENTION

1. Field of the Invention

The present invention relates to a pixel of a display panel and a driving method, and more particularly, to a pixel of a display panel and a driving method capable of compensating differences of electrical characteristics.

2. Description of the Prior Art

An organic light emitting diode display panel is a display device utilizing organic light emitting diode pixels to emit light for displaying images. Brightness of an organic light emitting diode is directly proportional to amount of current flowing through the organic light emitting diode. Generally, in order to control the amount of the current flowing through the organic light emitting diode, the organic light emitting diode pixel comprises a current control switch for controlling the amount of the current flowing through the organic light emitting diode according to display voltage at a gate end of the current control switch, so as to further control the brightness of the organic light emitting diode.

However, threshold voltage of the current control switch of each organic light emitting diode pixel may be different. Moreover, voltage across the organic light emitting diode may have variation due to aging of the organic light emitting diode. The above differences of electrical characteristics of the current control switch and the organic light emitting diode may affect the brightness of the organic light emitting diode. The organic light emitting diode display panel of the prior art is easy to be affected by the differences of electrical characteristics of the current control switch and the organic light emitting diode, such that image quality gets worse.

SUMMARY OF THE INVENTION

The present invention provides a pixel of a display panel comprising a first transistor with a first end coupled to a data line, a control end coupled to a scan line; a second transistor with a first end coupled to a first voltage source, a control end coupled to a second end of the first transistor; a third transistor with a first end coupled to a second end of the second transistor, a control end for receiving a control signal; a light emitting unit with a first end coupled to the second end of the second transistor, a second end coupled to a second voltage source; a first capacitor with a first end coupled to the second end of the first transistor, a second end coupled to a second end of the third transistor; and a second capacitor coupled between the second end of the first capacitor and the second voltage source.

The present invention further provides a driving method of a pixel of a display panel, comprising providing a display panel comprising a plurality of scan lines, a plurality of data lines, and a plurality of pixels, wherein each pixel comprises a first transistor, a second transistor, a third transistor, a light emitting unit, a first capacitor, and a second capacitor, a first end of the first transistor is coupled to a data line of the plurality of data lines, a control end of the first transistor is coupled to a scan line of the plurality of scan lines for receiving a scan signal, a first end of the second transistor is coupled to a first voltage source, a control end of the second transistor is coupled to a second end of the first transistor, a first end of the third transistor is coupled to a second end of the second transistor, a control end of the third transistor is for receiving a control signal, a first end of the light emitting unit is coupled to the second end of the second transistor, a second end of the light emitting unit is coupled to a second voltage source, a first end of the first capacitor is coupled to the second end of the first transistor, a second end of the first capacitor is coupled to a second end of the third transistor, a first end of the second capacitor is coupled to the second end of the first capacitor, and a second end of the second capacitor is coupled to the second voltage source; turning on the first transistor in a scanning period; in a first sub-period of the scanning period, the first end of the first transistor receiving a first voltage signal for resetting voltage levels of the first capacitor and the second capacitor; in a second sub-period of the scanning period, the first end of the first transistor receiving a second voltage signal different from the first voltage signal for writing compensation voltage into the second end of the first capacitor; in a third sub-period of the scanning period, the first end of the first transistor receiving a display voltage signal for compensating the display voltage signal according to the compensation voltage; and turning off the first transistor after the scanning period.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
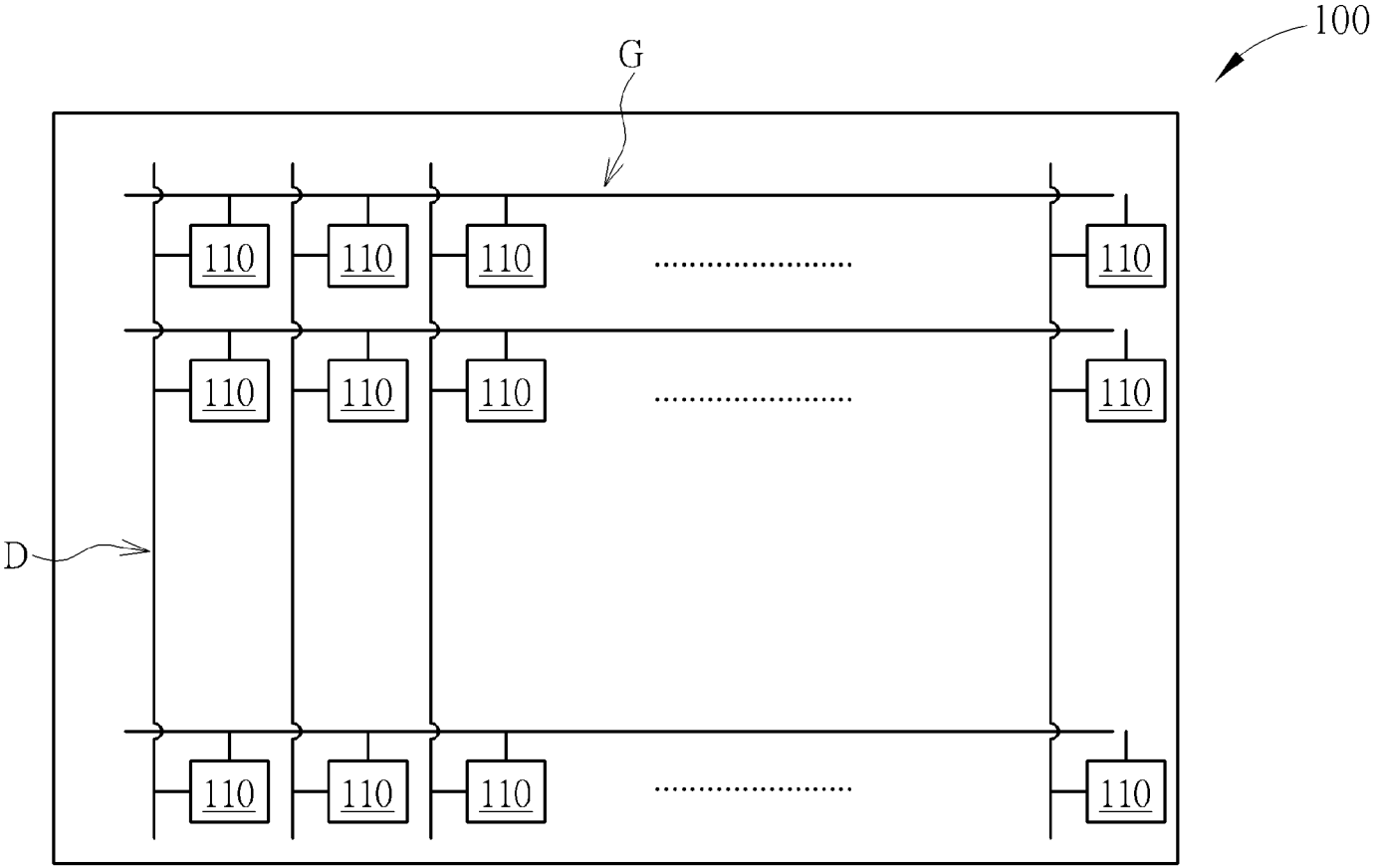
FIG. 1 is a diagram showing a display panel of the present invention.
Figure 2:
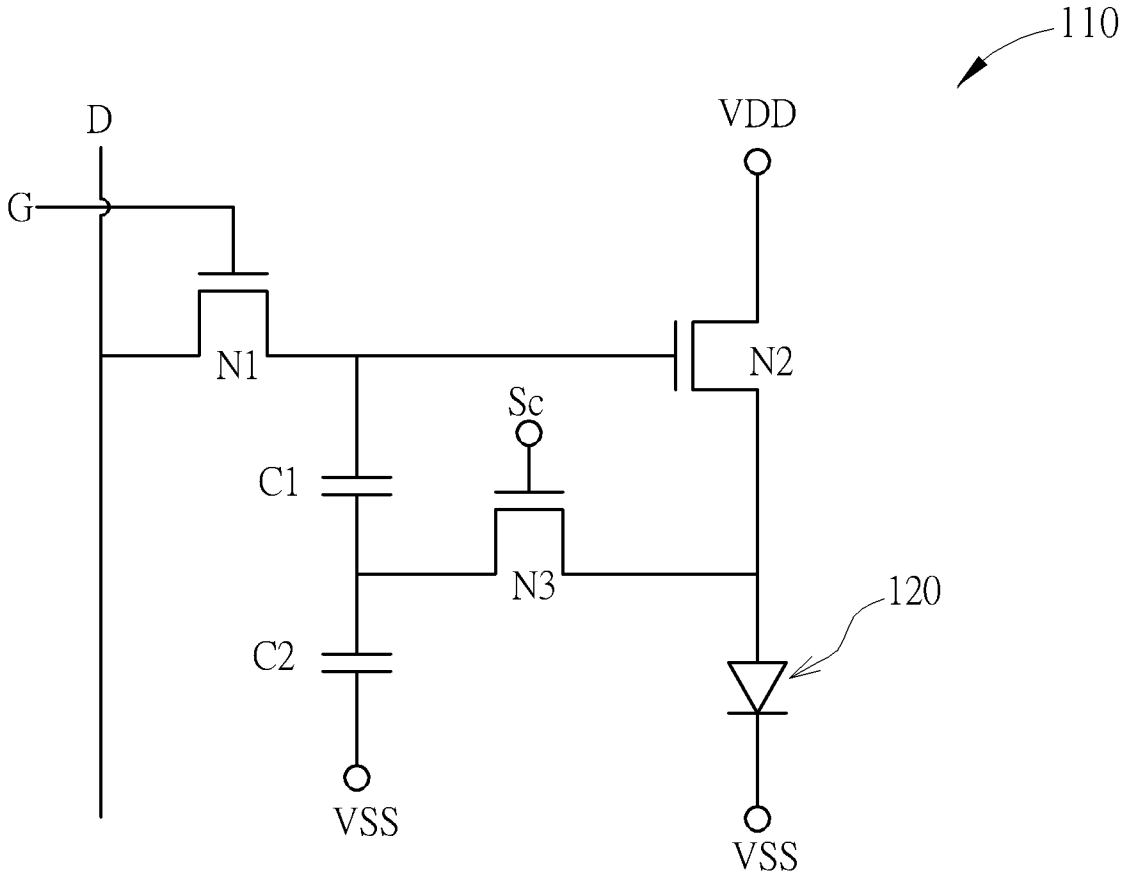
FIG. 2 is a diagram showing a pixel of the display panel in FIG. 1 according to a first embodiment of the present invention.

Please refer to FIG. 1 and FIG. 2 together. FIG. 1 is a diagram showing a display panel of the present invention.

FIG. 2 is a diagram showing a pixel of the display panel in FIG. 1 according to a first embodiment of the present invention. As shown in figures, the display panel 100 of the present invention comprises a plurality of scan lines G, a plurality of data lines D, and a plurality of pixels 110. Each pixel 110 comprises a first transistor N1, a second transistor N2, a third transistor N3, a light emitting unit 120, a first capacitor C1, and a second capacitor C2. A first end of the first transistor N1 is coupled to the data line D, and a control end of the first transistor N1 is coupled to the scan line G for receiving a scan signal Sg. A first end of the second transistor N2 is coupled to a high level voltage source VDD, and a control end of the second transistor N2 is coupled to a second end of the first transistor N1. A first end of the third transistor N3 is coupled to a second end of the second transistor N2, and a control end of the third transistor N3 is configured to receive a control signal Sc. A first end of the light emitting unit 120 is coupled to the second end of the second transistor, and a second end of the light emitting unit 120 is coupled to a low level voltage source VSS. A first end of the first capacitor C1 is coupled to the second end of the first transistor N1, and a second end of the first capacitor C1 is coupled to a second end of the third transistor N3. A first end of the second capacitor C2 is coupled to the second end of the first capacitor C1, and a second end of the second capacitor C2 is coupled to the low level voltage source VSS. The first transistor N1, the second transistor N2, and the third transistor N3 are N-type transistors, and the second transistor N2 is a current control switch. The light emitting unit 120 can be an organic light emitting diode or other types of current driven light emitting unit. A voltage level of the high level voltage source VDD is higher than a voltage level of the low level voltage source VSS.

Figure 3:
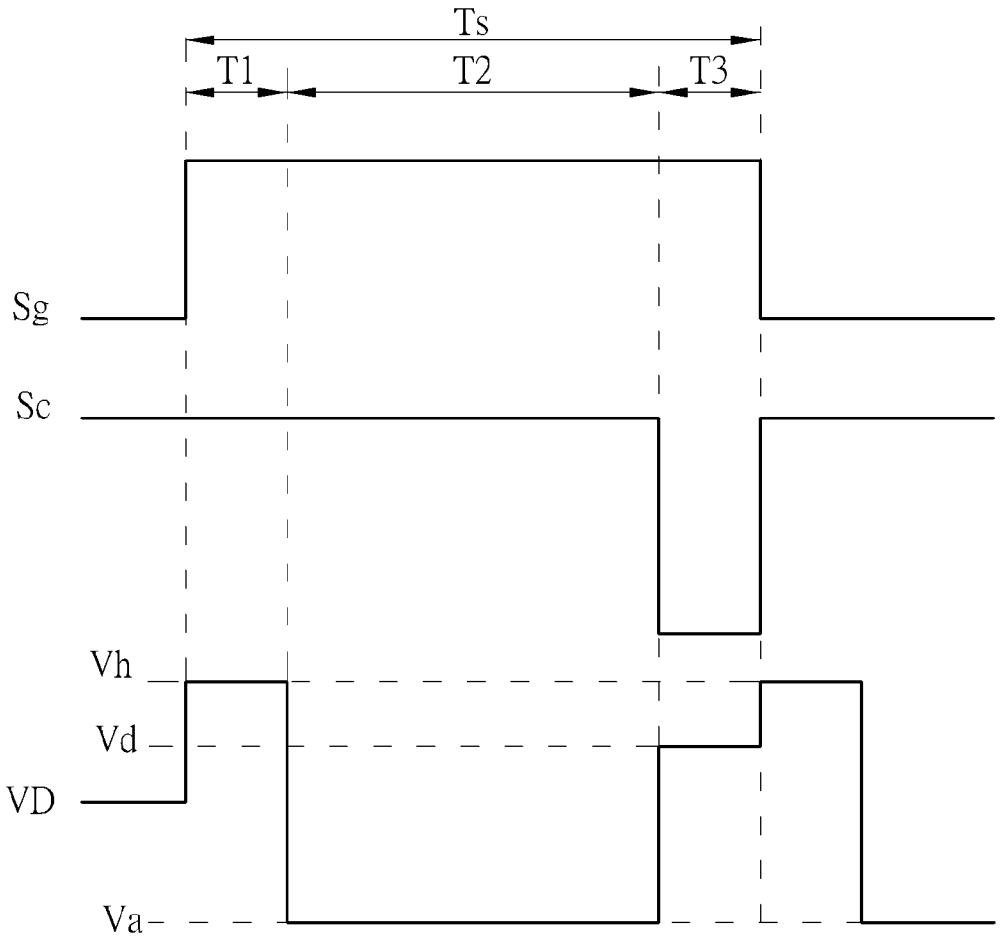
FIG. 3 is a diagram showing waveforms of related signals of the pixel according to the first embodiment of the present invention.
Figure 4:
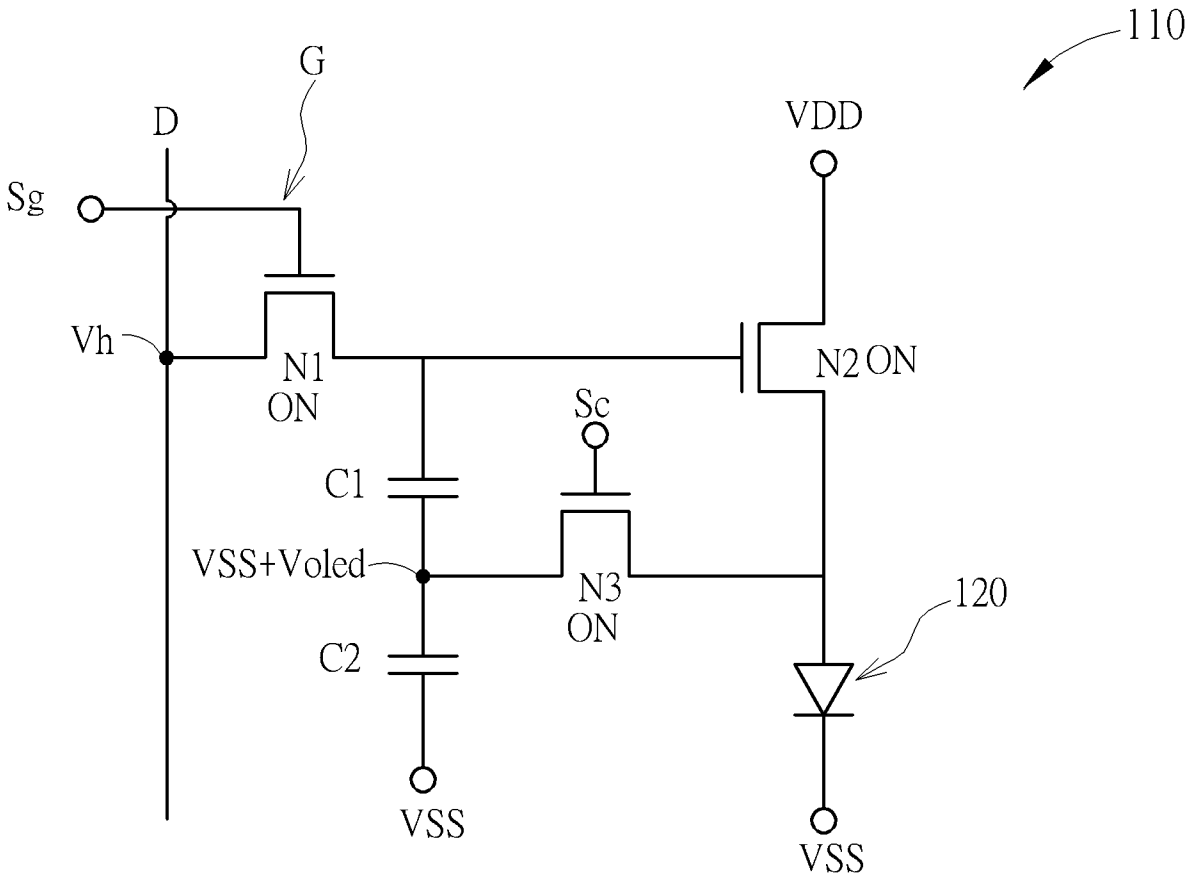
FIG. 4 is a diagram showing a driving method of the pixel according to the first embodiment of the present invention.

Please refer to FIG. 3 to FIG. 7. FIG. 3 is a diagram showing waveforms of related signals of the pixel according to the first embodiment of the present invention. FIG. 4 to FIG. 7 are diagrams showing a driving method of the pixel according to the first embodiment of the present invention. As shown in figures, when the first transistor N1 of the pixel 110 is turned on by the scan signal Sg during a scanning period Ts, in a first sub-period T1 of the scanning period Ts (as shown in FIG. 4), the first end of the first transistor N1 receives a first voltage signal Vh via the data line D, and the third transistor N3 is turned on by the control signal Sc, in order to reset voltage levels of the first capacitor C1 and the second capacitor C2. A voltage level at the first end of the first capacitor C1 is equal to a voltage level of the first voltage signal Vh, and a voltage level at the first end of the second capacitor C2 is equal to a result of adding up the voltage level of the low level voltage source VSS and a voltage level Voled across the light emitting unit.

Figure 5:
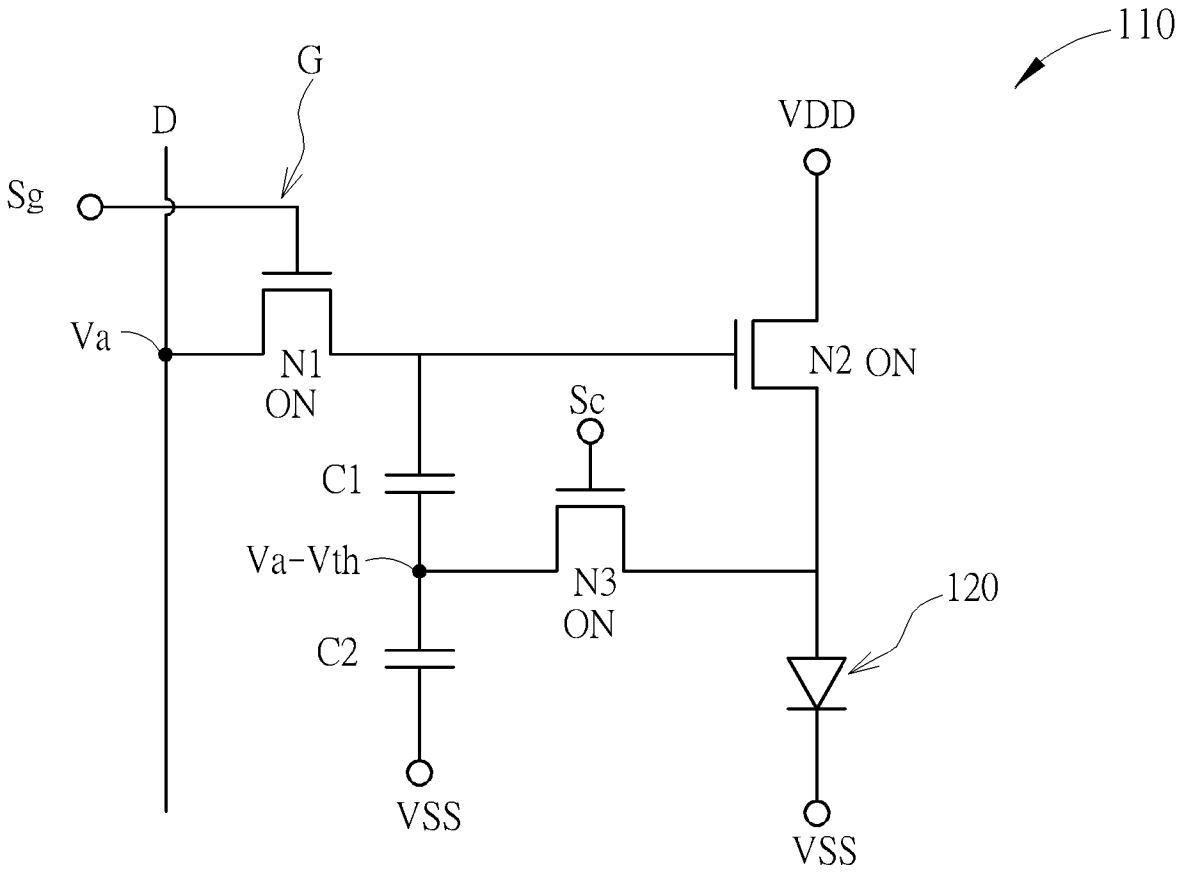
FIG. 5 is a diagram showing the driving method of the pixel according to the first embodiment of the present invention.

In a second sub-period T2 of the scanning period Ts (as shown in FIG. 5), the first end of the first transistor N1 receives a second voltage signal Va (the voltage level of the first voltage signal Vh is higher than a voltage level of the second voltage signal Va) via the data line D, and the third transistor N3 is turned on by the control signal Sc, in order to write compensation voltage into the second end of the first capacitor C1. For example, since the voltage level of the second voltage signal Va is lower than the voltage level of the first voltage signal Vh, when the first end of the first transistor N1 receives the second voltage signal Va via the data line D, the voltage level at the first end of the first capacitor C1 is dropped from the voltage level of the first voltage signal Vh to the voltage level of the second voltage signal Va, and a voltage level at the second end of the first capacitor C1 is pulled down due to capacitive coupling effect, such that a voltage difference Vgs between a gate end and a source end of the second transistor N2 is greater than a threshold voltage Vth of the second transistor N2. Therefore, the second capacitor C2 is charged until the voltage difference Vgs between the gate end and the source end of the second transistor N2 is equal to the threshold voltage Vth of the second transistor N2. The voltage level at the second end of the first capacitor C1 is then equal to a result of subtracting the threshold voltage Vth of the second transistor N2 from the voltage level of the second voltage signal Va.

Figure 6:
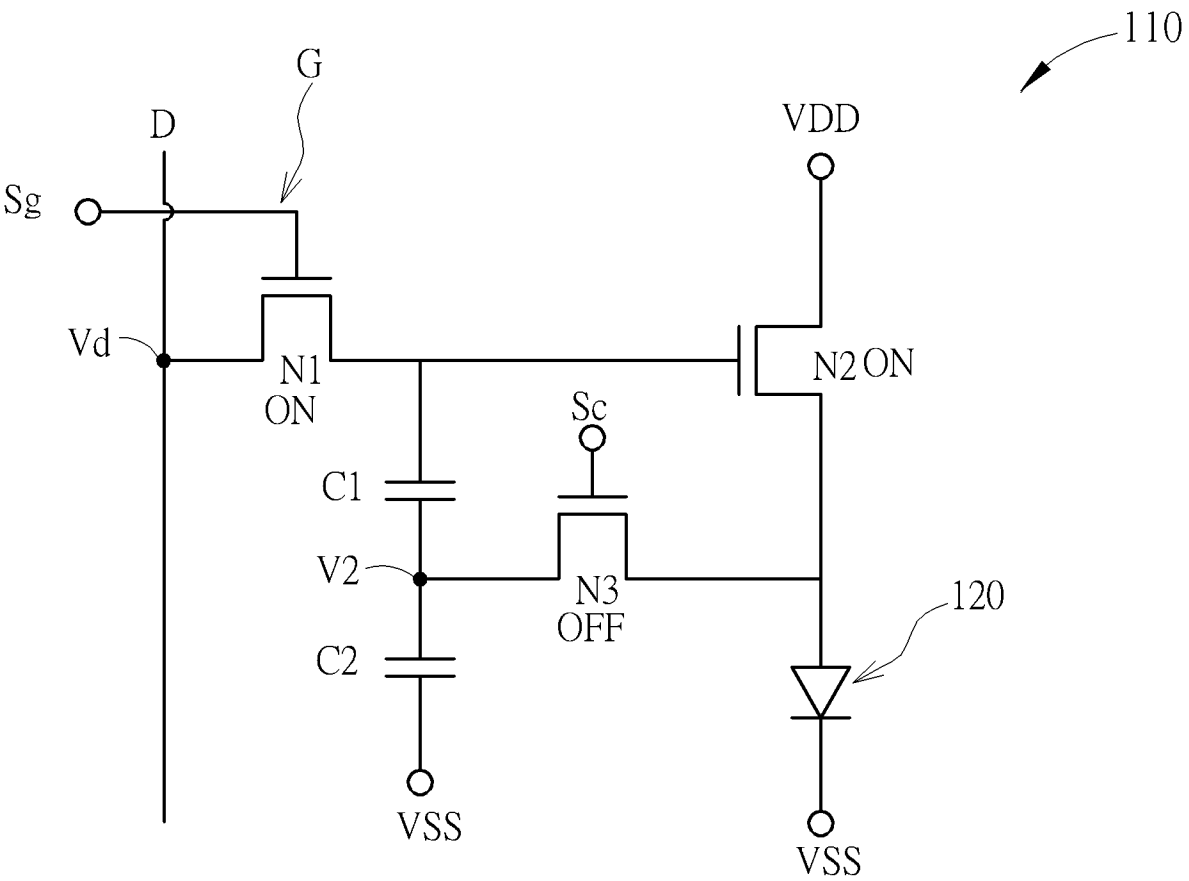
FIG. 6 is a diagram showing the driving method of the pixel according to the first embodiment of the present invention.

In a third sub-period T3 of the scanning period Ts (as shown in FIG. 6), the first end of the first transistor N1 receives a display voltage signal Vd (a voltage level of the display voltage signal Vd is between the voltage level of the first voltage signal Vh and the voltage level of the second voltage signal Va) via the data line D, and the third transistor N3 is turned off by the control signal Sc, in order to compensate the display voltage signal Vd according to the compensation voltage. For example, since the voltage level of the display voltage signal Vd is higher than the voltage level of the second voltage signal Va, when the first end of the first transistor N1 receives the display voltage signal Vd via the data line D, the voltage level at the first end of the first capacitor C1 is increased from the voltage level of the second voltage signal Va to the voltage level of the display voltage signal Vd, and the voltage level at the second end of the first capacitor C1 is pulled up due to the capacitive coupling effect. The voltage level at the second end of the first capacitor C1 can be obtained according to the following equation:

$$V2=\mathrm{Va}-\mathrm{Vth}+c1(\mathrm{Vd}-\mathrm{Va})/(c1+c2) \quad (1)$$

where c1 is capacitance of the first capacitor C1, and c2 is capacitance of the second capacitor C2.

Figure 7:
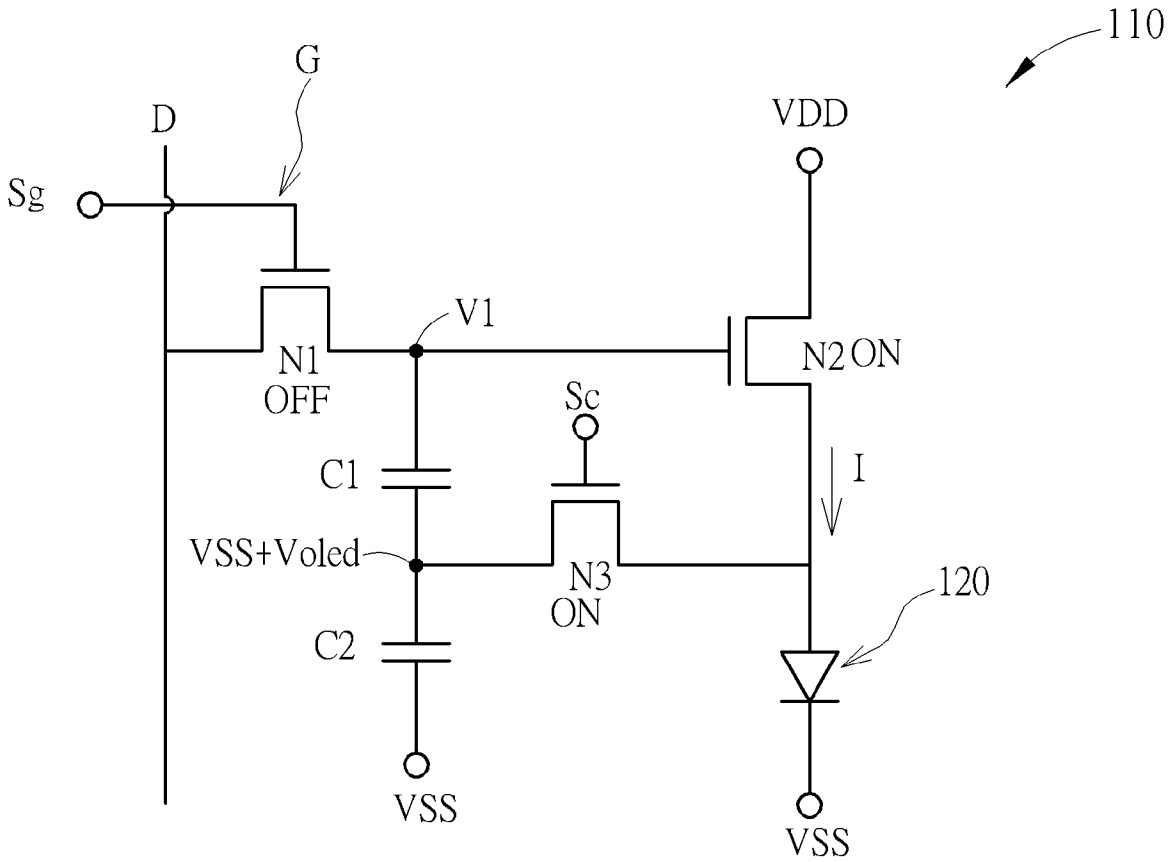
FIG. 7 is a diagram showing the driving method of the pixel according to the first embodiment of the present invention.

After the scanning period Ts (as shown in FIG. 7), the first transistor N1 is turned off, and the third transistor N3 is turned on by the control signal Sc, such that the second transistor N2 provides current I to the light emitting unit 120 according to the compensated display voltage signal for driving the light emitting unit 120 to emit light. For example, when the third transistor N3 is turned on by the control signal Sc, the voltage level at the second end of the first capacitor C1 is pulled up to be equal to a result of adding up the voltage level of the low level voltage source VSS and the voltage level Voled across the light emitting unit, and the voltage level at the first end of the first capacitor C1 is then pulled up due to the capacitive coupling effect. The voltage level at the first end of the first capacitor C1 can be obtained according to the following equation:

$$V1=\mathrm{Vd}+(\mathrm{VSS}+\mathrm{Voled})-[\mathrm{Va}-\mathrm{Vth}+c1(\mathrm{Vd}-\mathrm{Va})/(c1+c2)] \quad (2)$$

And the current flowing through the second transistor can be obtained according to the following equation:

$$I=K(\mathrm{Vgs}-\mathrm{Vth})^2=K[V1-(\mathrm{VSS}+\mathrm{Voled})-\mathrm{Vth}]^2 \quad (3)$$

where K is a constant. In addition, according to equation (2) and equation (3), the current flowing through the second transistor can be further obtained according to the following equation:

$$I=K[(1-c1/(c1+c2))(\mathrm{Vd}-\mathrm{Va})]^2 \quad (4)$$

According to the above arrangement, the current flowing through the second transistor N2 is no longer related to the threshold voltage Vth of the second transistor N2 and the voltage Voled across the light emitting unit 120. The display panel 100 of the present invention only needs to control voltage levels of the second voltage signal Va and the display voltage signal Vd, in order to preciously control brightness of the light emitting unit 120. Therefore, pixel brightness of the display panel of the present invention is not affected by the differences of electrical characteristics of the current control switch and the organic light emitting diode.

Figure 8:
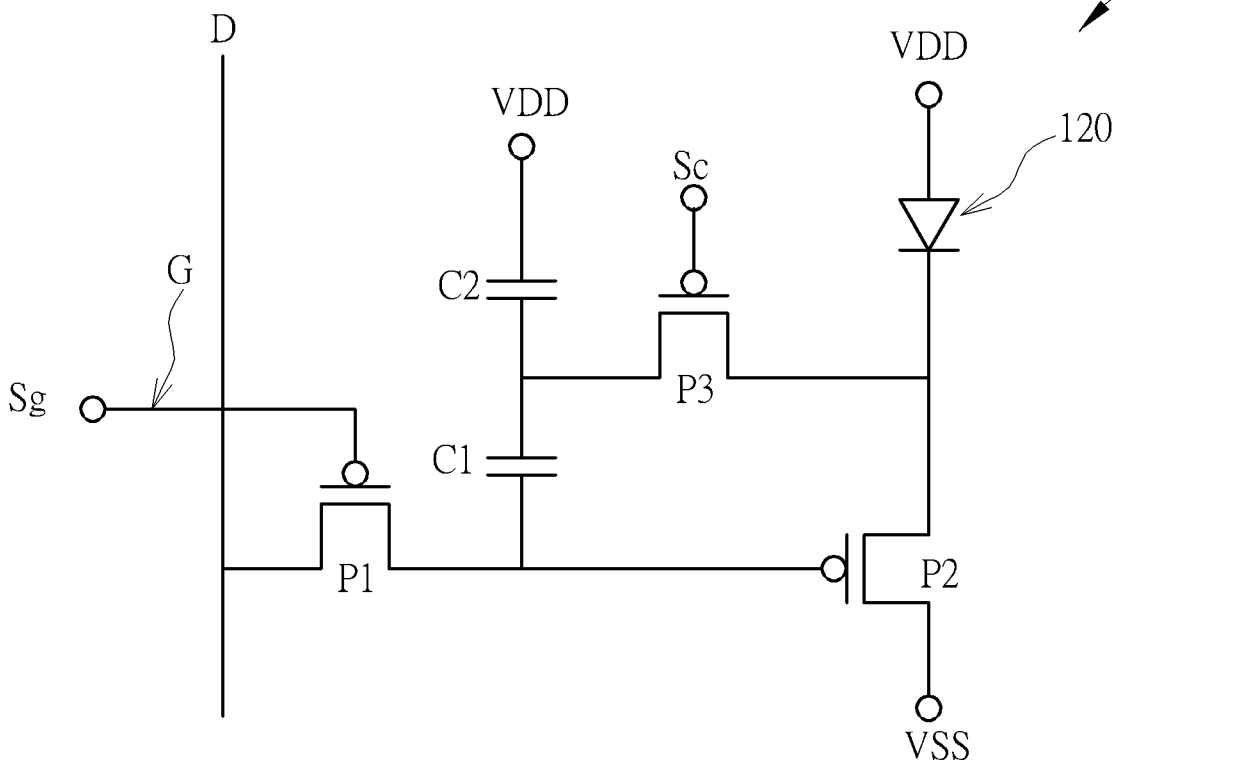
FIG. 8 is a diagram showing a pixel of the display panel in FIG. 1 according to a second embodiment of the present invention.

Please refer to FIG. 8. FIG. 8 is a diagram showing a pixel of the display panel in FIG. 1 according to a second embodiment of the present invention. As shown in FIG. 8, each pixel 110 comprises a first transistor P1, a second transistor P2, a third transistor P3, a light emitting unit 120, a first capacitor C1, and a second capacitor C2. A first end of the first transistor P1 is coupled to the data line D, and a control end of the first transistor P1 is coupled to the scan line G for receiving a scan signal Sg. A first end of the second transistor P2 is coupled to a low level voltage source VSS, and a control end of the second transistor P2 is coupled to a second end of the first transistor P1. A first end of the third transistor P3 is coupled to a second end of the second transistor P2, and a control end of the third transistor P3 is configured to receive a control signal Sc. A first end of the light emitting unit 120 is coupled to the second end of the second transistor P2, and a second end of the light emitting unit 120 is coupled to a high level voltage source VDD. A first end of the first capacitor C1 is coupled to the second end of the first transistor P1, and a second end of the first capacitor C1 is coupled to a second end of the third transistor P3. A first end of the second capacitor C2 is coupled to the second end of the first capacitor C1, and a second end of the second capacitor C2 is coupled to the high level voltage source VDD. The first transistor P1, the second transistor P2, and the third transistor P3 are P-type transistors, and the second transistor P2 is a current control switch. The light emitting unit 120 can be an organic light emitting diode or other types of current driven light emitting unit. A voltage level of the high level voltage source VDD is higher than a voltage level of the low level voltage source VSS.

Figure 9:
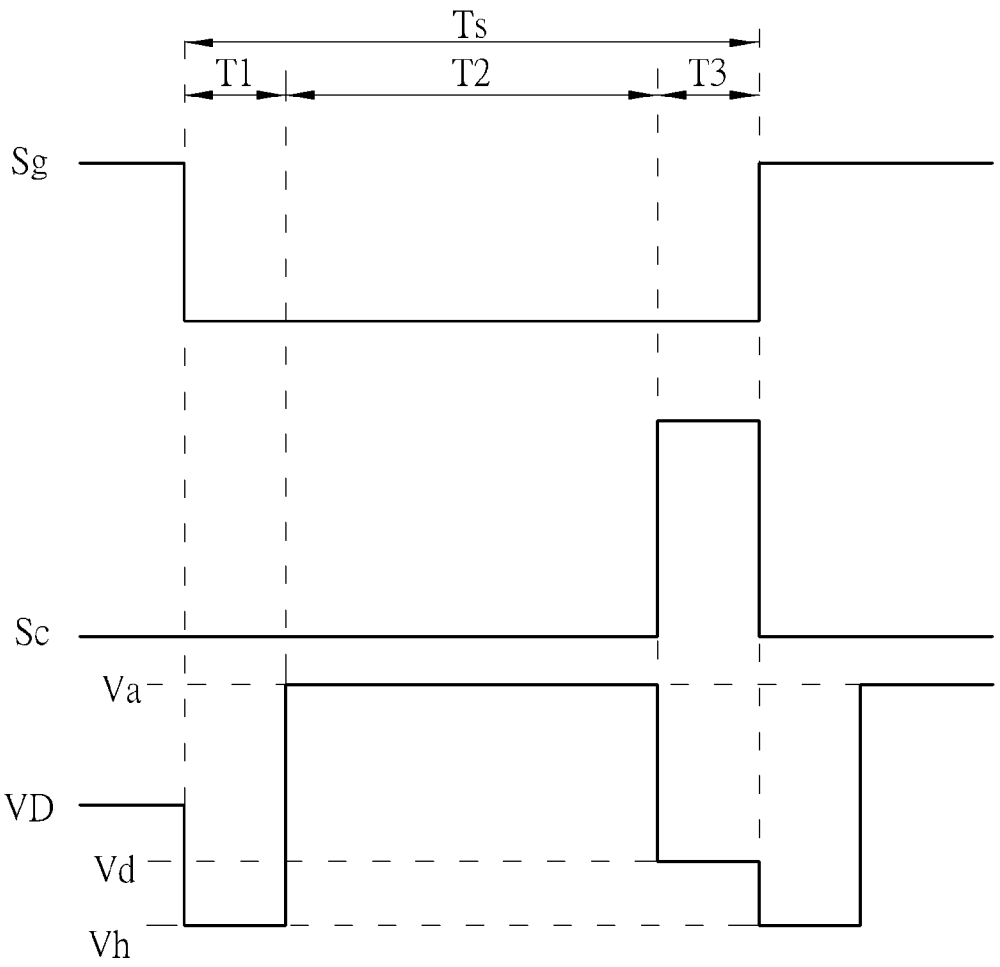
FIG. 9 is a diagram showing waveforms of related signals of the pixel according to the second embodiment of the present invention.
Figure 10:
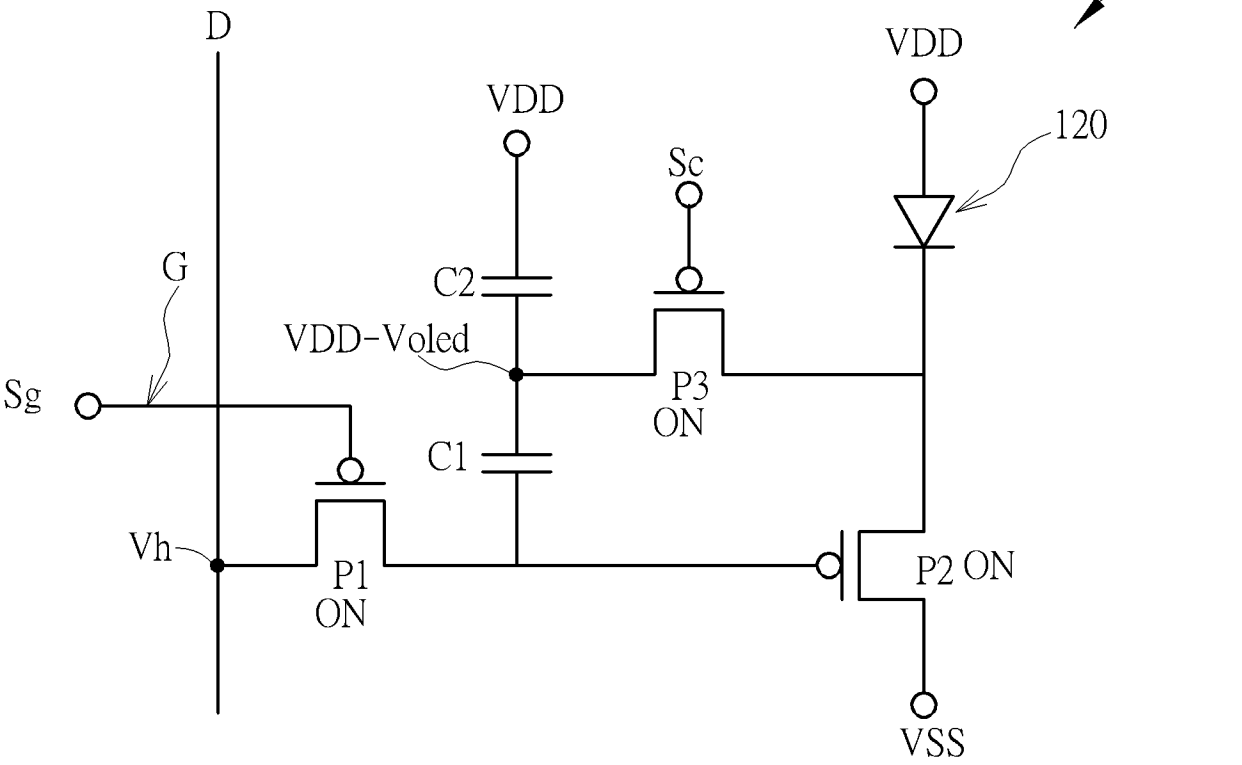
FIG. 10 is a diagram showing a driving method of the pixel according to the second embodiment of the present invention.

Please refer to FIG. 9 to FIG. 13. FIG. 9 is a diagram showing waveforms of related signals of the pixel according to the second embodiment of the present invention. FIG. 10 to FIG. 13 are diagrams showing a driving method of the pixel according to the second embodiment of the present invention. As shown in figures, when the first transistor P1 of the pixel 110 is turned on by the scan signal Sg during a scanning period Ts, in a first sub-period T1 of the scanning period Ts (as shown in FIG. 10), the first end of the first transistor P1 receives a first voltage signal Vh via the data line D, and the third transistor P3 is turned on by the control signal Sc, in order to reset voltage levels of the first capacitor C1 and the second capacitor C2. A voltage level at the first end of the first capacitor C1 is equal to a voltage level of the first voltage signal Vh, and a voltage level at the first end of the second capacitor C2 is equal to a result of subtracting the voltage level Voled across the light emitting unit form the voltage level of the high level voltage source VDD.

Figure 11:
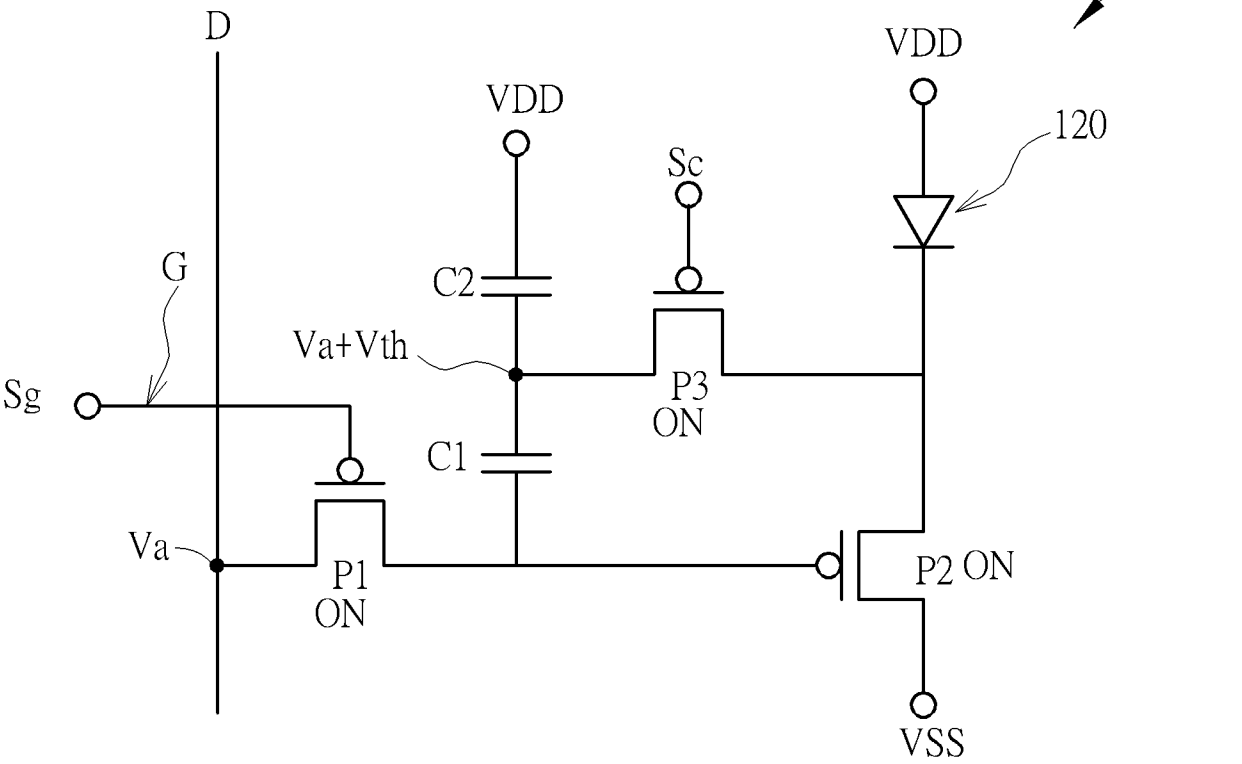
FIG. 11 is a diagram showing the driving method of the pixel according to the second embodiment of the present invention.

In a second sub-period T2 of the scanning period Ts (as shown in FIG. 11), the first end of the first transistor P1 receives a second voltage signal Va (the voltage level of the first voltage signal Vh is lower than a voltage level of the second voltage signal Va) via the data line D, and the third transistor P3 is turned on by the control signal Sc, in order to write compensation voltage into the second end of the first capacitor C1. For example, since the voltage level of the second voltage signal Va is higher than the voltage level of the first voltage signal Vh, when the first end of the first transistor P1 receives the second voltage signal Va via the data line D, the voltage level at the first end of the first capacitor C1 is increased from the voltage level of the first voltage signal Vh to the voltage level of the second voltage signal Va, and a voltage level at the second end of the first capacitor C1 is pulled up due to the capacitive coupling effect, such that a voltage difference Vsg between a source end and a gate end of the second transistor P2 is greater than a threshold voltage Vth of the second transistor P2. Therefore, the first capacitor C1 is discharged until the voltage difference Vsg between the source end and the gate end of the second transistor P2 is equal to the threshold voltage Vth of the second transistor P2. The voltage level at the second end of the first capacitor C1 is then equal to a result of adding up the voltage level of the second voltage signal Va and the threshold voltage Vth of the second transistor P2.

Figure 12:
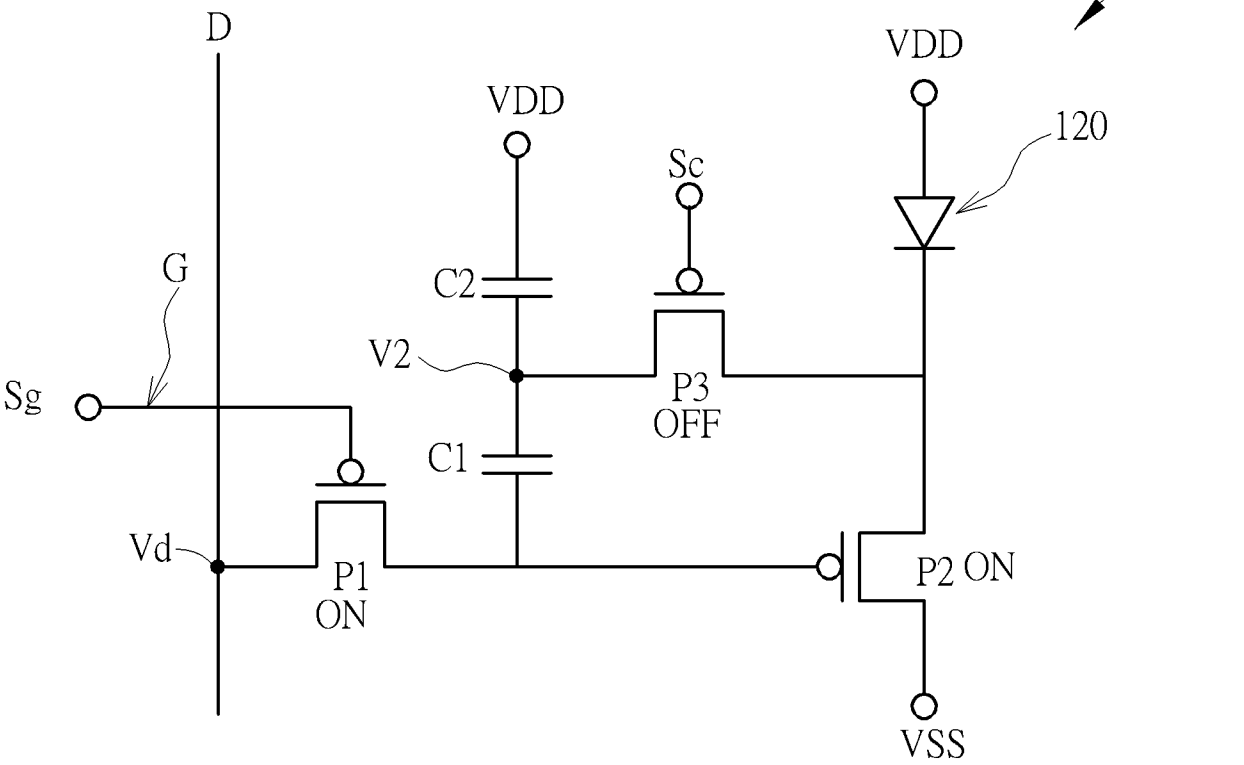
FIG. 12 is a diagram showing the driving method of the pixel according to the second embodiment of the present invention.

In a third sub-period T3 of the scanning period Ts (as shown in FIG. 12), the first end of the first transistor P1 receives a display voltage signal Vd (a voltage level of the display voltage signal Vd is between the voltage level of the first voltage signal Vh and the voltage level of the second voltage signal Va) via the data line D, and the third transistor P3 is turned off by the control signal Sc, in order to compensate the display voltage signal Vd according to the compensation voltage. For example, since the voltage level of the display voltage signal Vd is lower than the voltage level of the second voltage signal Va, when the first end of the first transistor P1 receives the display voltage signal Vd via the data line D, the voltage level at the first end of the first capacitor C1 is dropped from the voltage level of the second voltage signal Va to the voltage level of the display voltage signal Vd, and the voltage level at the second end of the first capacitor C1 is pulled down due to the capacitive coupling effect. The voltage level at the second end of the first capacitor C1 can be obtained according to the following equation:

$$V2=\mathrm{Va}+\mathrm{Vth}-c1(\mathrm{Va}-\mathrm{Vd})/(c1+c2) \tag{5}$$

Figure 13:
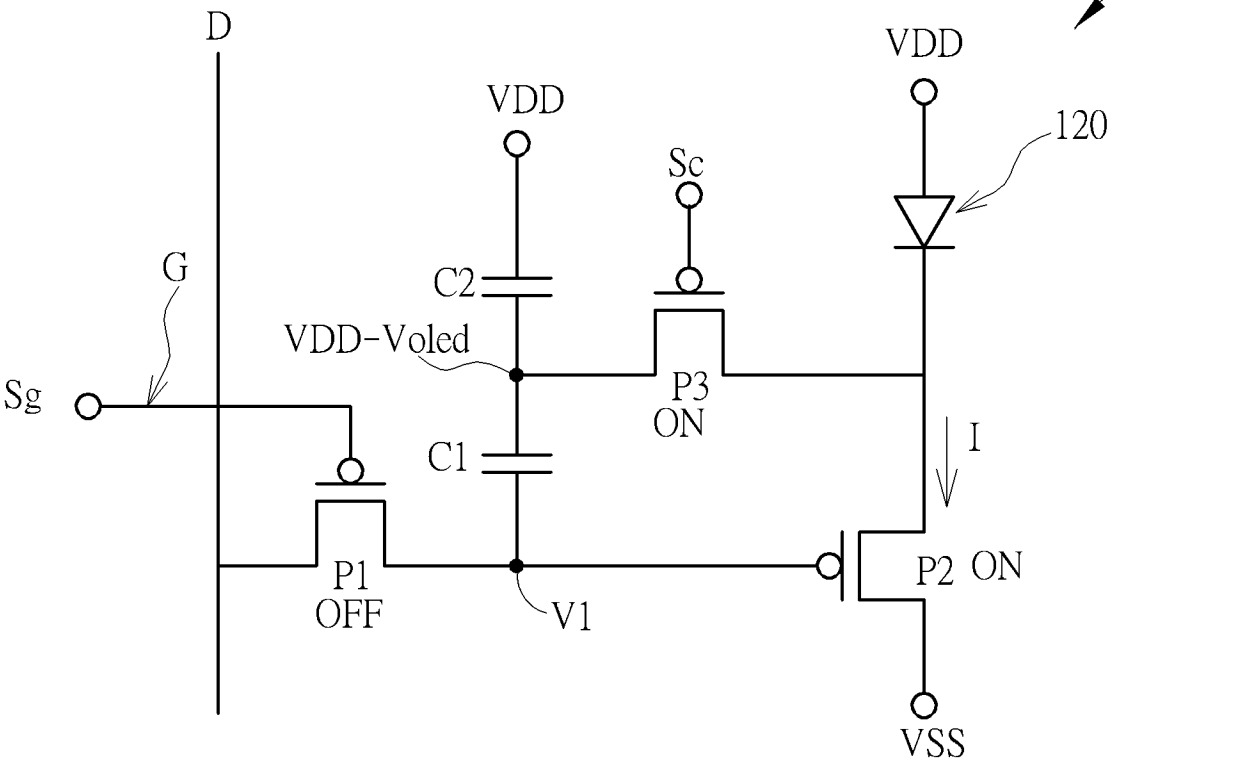
FIG. 13 is a diagram showing the driving method of the pixel according to the second embodiment of the present invention.

After the scanning period Ts (as shown in FIG. 13), the first transistor P1 is turned off, and the third transistor P3 is turned on by the control signal Sc, such that the second transistor P2 provides current I to the light emitting unit 120 according to the compensated display voltage signal for driving the light emitting unit 120 to emit light. For example, when the third transistor P3 is turned on by the control signal Sc, the voltage level at the second end of the first capacitor C1 is pulled up to be equal to a result of subtracting the voltage level Voled across the light emitting unit from the voltage level of the high level voltage source VDD, and the voltage level at the first end of the first capacitor C1 is then pulled up due to the capacitive coupling effect. The voltage level at the first end of the first capacitor C1 can be obtained according to the following equation:

$$V1=\mathrm{Vd}+(\mathrm{VDD}-\mathrm{Voled})-[\mathrm{Va}+\mathrm{Vth}-c1(\mathrm{Va}-\mathrm{Vd})/(c1+c2)] \tag{6}$$

And the current flowing through the second transistor can be obtained according to the following equation:

$$I=K(Vsg-Vth)^2=K[(VDD-Voled)-V1-Vth]^2 \tag{7}$$

where K is a constant. In addition, according to equation (6) and equation (7), the current flowing through the second transistor can be further obtained according to the following equation:

$$I=K[(1-c1/(c1+c2))(\mathrm{Va}-\mathrm{Vd})]^2 \tag{8}$$

According to the above arrangement, the current flowing through the second transistor P2 is no longer related to the threshold voltage Vth of the second transistor P2 and the voltage Voled across the light emitting unit 120. The display panel 100 of the present invention only needs to control voltage levels of the second voltage signal Va and the display voltage signal Vd, in order to preciously control brightness of the light emitting unit 120. Therefore, pixel brightness of the display panel of the present invention is not affected by the differences of electrical characteristics of the current control switch and the organic light emitting diode.

In contrast to the prior art, the pixel of the display panel of the present invention and its control method can compensate the differences of electrical characteristics of the current control switch and the organic light emitting diode. Therefore, image quality of the display panel of the present invention won' t be affected by the differences of electrical characteristics of the current control switch and the organic light emitting diode, so as to further improve image quality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pixel of a display panel, comprising:

a first transistor with a first end directly coupled to a data line, and a control end coupled to a scan line for receiving a scan signal, wherein the first transistor is turned on in a scanning period and turned off after the scanning period, the first end of the first transistor receives a first voltage signal in a first sub-period of the scanning period, receives a second voltage signal different from the first voltage signal in a second sub-period of the scanning period, and receives a display voltage signal in a third sub-period of the scanning period;

a second transistor with a first end coupled to a first voltage source, and a control end coupled to a second end of the first transistor;

a third transistor with a first end coupled to a second end of the second transistor, and a control end for receiving a control signal, wherein the third transistor is turned on by the control signal in the first sub-period, in the second sub-period, and after the scanning period, and the third transistor is turned off by the control signal in the third sub-period;

a light emitting unit with a first end coupled to the second end of the second transistor, and a second end coupled to a second voltage source;

a first capacitor with a first end directly coupled to the second end of the first transistor, and a second end directly coupled to a second end of the third transistor; and a second capacitor with a first end coupled to the second end of the first capacitor, and a second end coupled to the second voltage source.

2. The pixel of claim 1, wherein the first transistor, the second transistor, and the third transistor are N-type transistors.

3. The pixel of claim 2, wherein a voltage level of the first voltage source is higher than a voltage level of the second voltage source, and a voltage level of the first voltage signal is higher than a voltage level of the second voltage signal.

4. The pixel of claim 1, wherein the first transistor, the second transistor, and the third transistor are P-type transistors.

5. The pixel of claim 4, wherein a voltage level of the first voltage source is lower than a voltage level of the second voltage source, and a voltage level of the first voltage signal is lower than a voltage level of the second voltage signal.

6. The pixel of claim 1, wherein the light emitting unit is an organic light-emitting diode.

7. A driving method of a pixel of a display panel, comprising:

providing a display panel comprising a plurality of scan lines, a plurality of data lines, and a plurality of pixels, wherein each pixel comprises a first transistor, a second transistor, a third transistor, a light emitting unit, a first capacitor, and a second capacitor, a first end of the first transistor is directly coupled to a data line of the plurality of data lines, a control end of the first transistor is coupled to a scan line of the plurality of scan lines for receiving a scan signal, a first end of the second transistor is coupled to a first voltage source, a control end of the second transistor is coupled to a second end of the first transistor, a first end of the third transistor is coupled to a second end of the second transistor, a control end of the third transistor is for receiving a control signal, a first end of the light emitting unit is coupled to the second end of the second transistor, a second end of the light emitting unit is coupled to a second voltage source, a first end of the first capacitor is directly coupled to the second end of the first transistor, a second end of the first capacitor is directly coupled to a second end of the third transistor, a first end of the second capacitor is coupled to the second end of the first capacitor, and a second end of the second capacitor is coupled to the second voltage source;

turning on the first transistor in a scanning period;

in a first sub-period of the scanning period, the first end of the first transistor receiving a first voltage signal for resetting voltage levels of the first capacitor and the second capacitor, and turning on the third transistor;

in a second sub-period of the scanning period, the first end of the first transistor receiving a second voltage signal different from the first voltage signal for writing compensation voltage into the second end of the first capacitor, and turning on the third transistor;

in a third sub-period of the scanning period, the first end of the first transistor receiving a display voltage signal for compensating the display voltage signal according to the compensation voltage, and turning off the third transistor; and turning off the first transistor and turning on the third transistor after the scanning period.

8. The driving method of claim 7, further comprising:

after the scanning period, the second transistor providing current to the light emitting unit according to the compensated display voltage signal for driving the light emitting unit to emit light.

* * * * *